United States Patent [19]

Zion

[11] 4,006,613

[45] Feb. 8, 1977

[54] LOCK PICK MECHANISM

[75] Inventor: Westley Zion, New York, N.Y.

[73] Assignee: Majestic Lock Co., Inc., New York, N.Y.

[22] Filed: Feb. 11, 1976

[21] Appl. No.: 657,193

[52] U.S. Cl. ..... 70/394; 7/16; 70/456 R

[51] Int. Cl.[2] ..... E05B 19/20; A47G 29/10

[58] Field of Search ..... 70/394, 456–459; 7/16; 24/3 K

[56] References Cited

UNITED STATES PATENTS

| | | | |
|---|---|---|---|
| 1,036,664 | 8/1912 | Marble | 7/16 |
| 2,473,758 | 6/1949 | Maitlen | 70/456 R X |
| 2,503,380 | 4/1950 | Derby | 70/456 R X |
| 2,836,053 | 5/1958 | Starrett | 70/456 R |
| 3,452,562 | 7/1969 | Loveless | 70/394 |
| 3,813,907 | 6/1974 | Jones | 70/456 R |

*Primary Examiner*—Robert L. Wolfe
*Attorney, Agent, or Firm*—Gottlieb, Rackman, Reisman & Kirsch

[57] ABSTRACT

A lock pick mechanism having a plurality of lock picks, a frame and housing members is disclosed. The lock picks, frame and housing members are connected together such that the lock picks may be contained within the frame and enclosed by the housing members when the lock picks are in their storage positions and such that an individual lock pick may be selected and pivotally moved from its storage to its operative position when the housing members are opened. After the selected lock pick has been moved to its operative position, the housing members may be closed to maintain the lock pick in its operative position.

9 Claims, 8 Drawing Figures

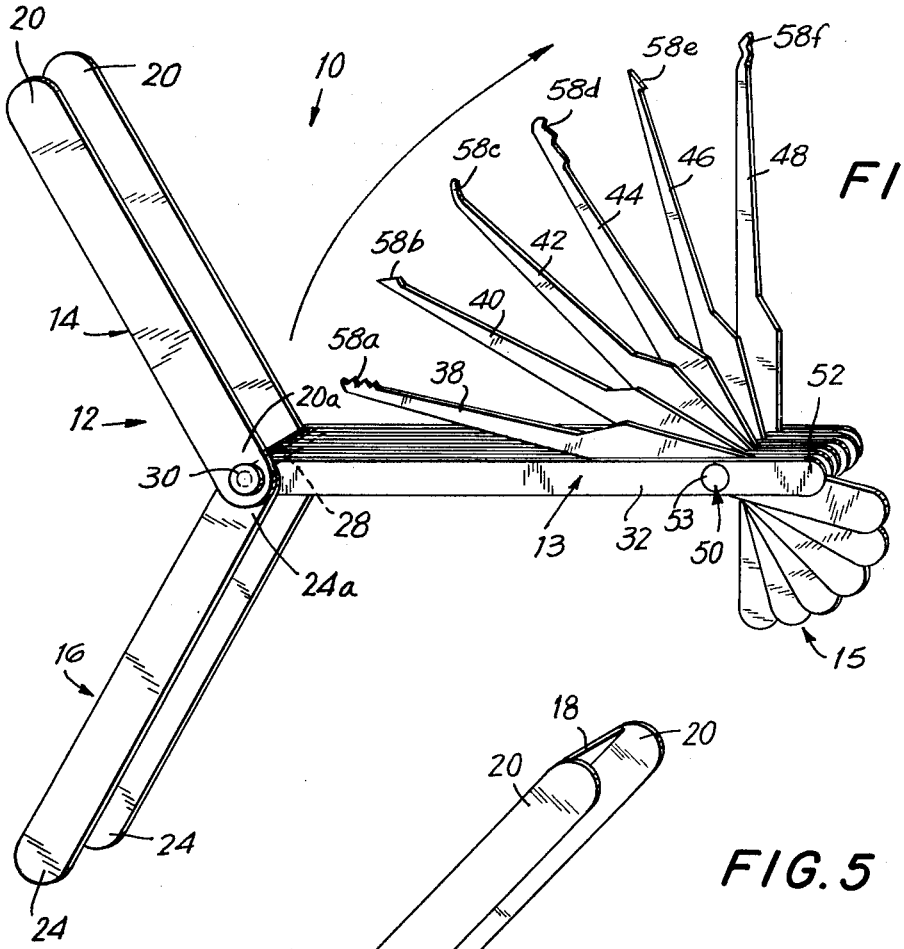
FIG. 4
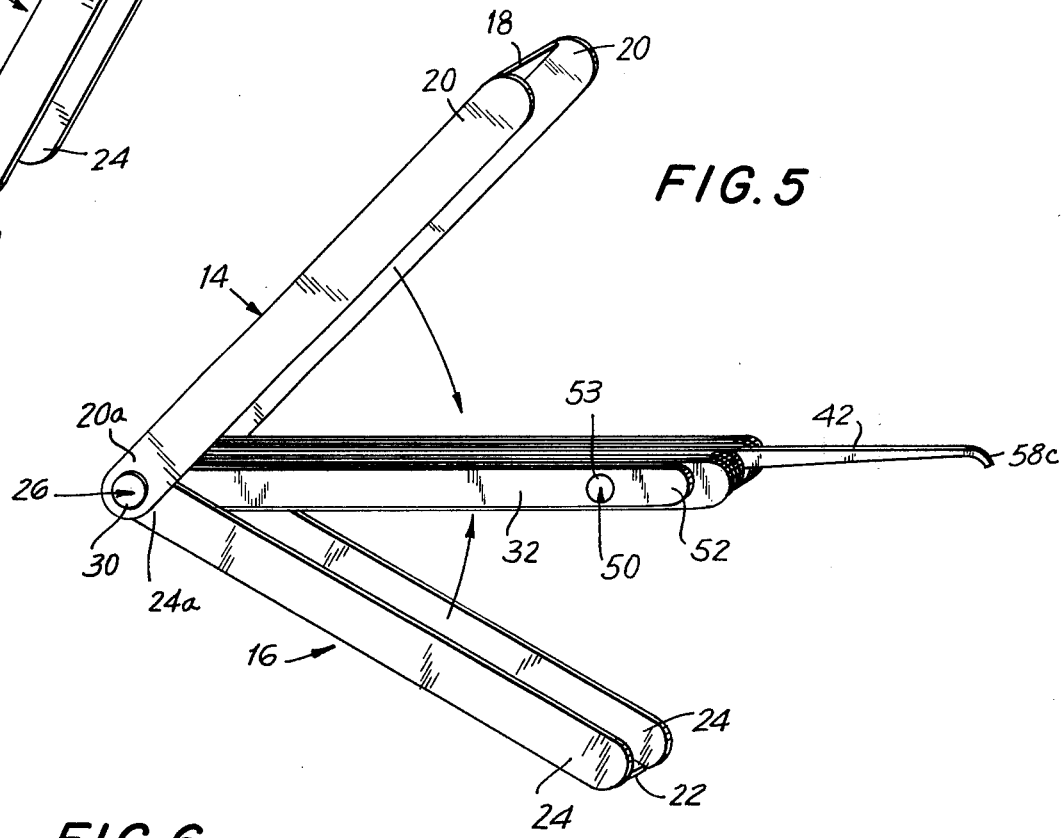
FIG. 5
FIG. 6
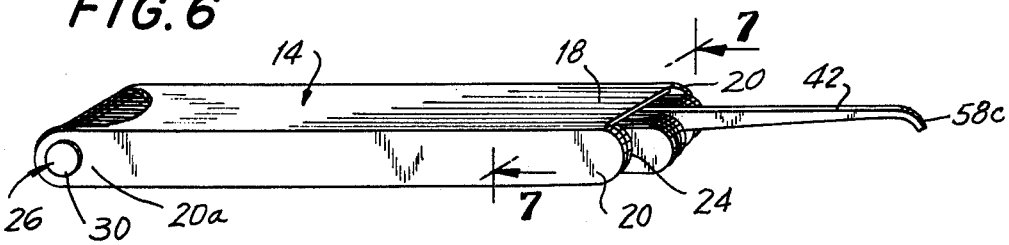

LOCK PICK MECHANISM

This invention relates generally to lock picks and, more particularly, to a lock pick mechanism for holding a plurality of lock picks in storage and operative positions.

The use of lock picks, for the purpose of opening tumbler locks or similar mechanisms, is generally well known in the art. It is usually necessary for a user to utilize several lock picks in order to open the tumbler mechanism. It is thus necessary for a user to have available several types of lock picks. Previously, it was the practice for a user to store the lock picks separately, for example, by keeping the lock picks in a tool box or similar container or some type of carrying case. The lock picks were usually not connected together and, after a single lock pick had been utilized, it was the practice for the lock pick to be put back in the carrying case and for another lock pick to be taken out of the carrying case for use. This was a cumbersome and rather time consuming practice.

In order to overcome the above disadvantages, it has been proposed to use a lock pick holder which would store a plurality of lock picks, and enable a single lock pick to be selected for use and held in an operative position. Such a lock pick holder is described in U.S. Pat. No. 3,452,562 which issued to H. L. Loveless on July 1, 1969.

In the Loveless patent, there is disclosed a plurality of lock picks which are pivotally connected for movement between storage and operative positions within a lock pick holder. The lock pick holder includes a movable sleeve 14 which slides over the frame of the holder and which serves to lock an extended lock pick in place.

Although the lock pick holder disclosed in the Loveless patent provides a decided advantage over keeping a plurality of lock picks loose in a tool case or the like, it suffers from several disadvantages. One disadvantage is that the Loveless lock pick holder is somewhat cumbersome to use. Specifically, the provision of a separate, slidable sleeve, which must be slipped off the frame of the holder to select a lock pick and which must, thereafter, be slid back over the frame to keep a selected lock pick in place, is difficult and time-consuming to operate. Thus, the sleeve in Loveless must be lined up with the frame and inserted into grooves provided at the bottom of the frame. Moreover, the construction of the lock pick holder shown in Loveless is somewhat complicated, requiring close tolerances between the slidable sleeve and the frame, as well as requiring cut outs and flanges for allowing the sleeve to be maintained on the frame. Such a construction increases manufacturing costs, and the eventual cost of the overall item.

Accordingly, it is a broad object of the present invention to provide an improved lock pick mechanism for holding a plurality of lock picks in storage and operative positions.

Another object of this invention is to provide a lock pick mechanism which is relatively inexpensive to construct and which operates in a satisfactory manner.

Yet another object of this invention is to provide a lock pick mechanism which overcomes the difficulties encountered in using a plurality of lock picks, according to the prior art.

These and other objects of the present invention are accomplished by providing a lock pick mechanism having first and second housing members which are connected together by a first pivot means which enables movement of the housing members between open and closed positions. A frame is secured, at one end thereof, to the first pivot means, with the frame adapted to contain a plurality of lock picks. The lock picks are connected near the other end of the frame by a second pivot means for allowing pivotal movement of the lock picks between storage and operative positions. Each of the lock picks has a pick end which faces toward the first pivot means when the lock pick is in its storage position and which faces away from the first pivot means when the lock pick is in its operative position. The lock picks, housing members and frame are connected such that the pick ends are contained within the frame and enclosed by the housing members when the lock picks are in their storage positions and when the housing members are in their closed positions, and such that any individual one of the lock picks may be selectively rotated, about the second pivot means, from its storage position to its operative position when the housing members are in their open positions. The selected lock pick is maintained or locked in its operative position, with its pick end extending from the frame and from the housing members, when the housing members have been moved from their open positions to their closed positions.

The above brief description of a presently preferred, but nonetheless illustrative embodiment, of the present invention will be more readily apparent by consideration of the following detailed description, when taken in conjunction with the following drawings, wherein:

FIG. 4 is a view similar to that of FIG. 1, but showing both housing members in their open positions and further showing the manner of selecting an individual lock pick;

FIG. 5 is a view similar to that of FIG. 1, but showing movement of the housing members toward their closed positions and further showing one of the lock picks in its operative position.

FIG. 6 is a view similar to that of FIG. 1, but showing a selected lock pick in its operative position, locked in said position by the closed housing members;

Figure 1:
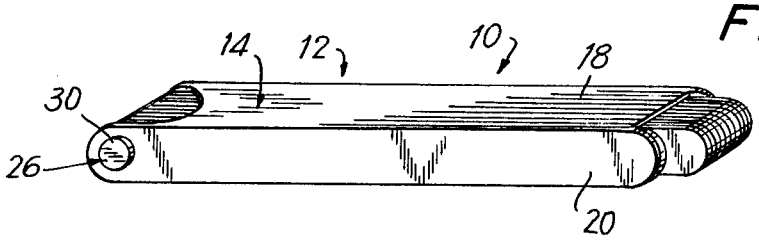
FIG. 1 is a front perspective view of the lock pick mechanism of the present invention, showing the housing members in their closed positions and the lock picks in their storage positions.

Referring now to the drawings, the lock pick mechanism according to the present invention is generally designated 10. The lock pick mechanism includes a housing, generally designated 12, a frame, generally designated 13, and a plurality of lock picks, generally designated 15 (see FIG. 4).

Figure 7:
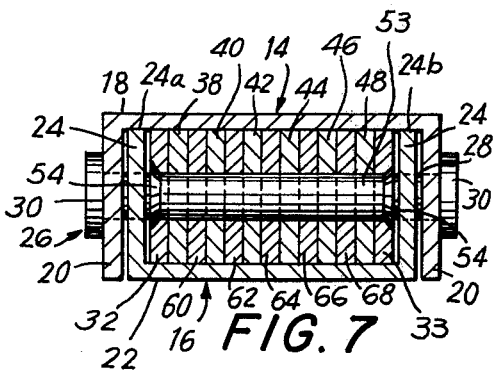
FIG. 7 is a sectional view, enlarged in scale, taken substantially along the line 7—7 of FIG. 6.

The housing comprises a first or top housing member 14 and a second or bottom housing member 16. First housing member 14 includes a generally flat, top wall 18 and downwardly depending side walls 20. Thus, and as best illustrated in FIG. 7, first housing member 14 is generally U-shaped in cross-section. Similarly, the second housing member 16 includes a generally flat, bottom wall 22 and upstanding side walls 24, providing a generally U-shaped cross-section for the second housing member.

As illustrated in FIG. 7, the top and side walls of first housing member 14 and the bottom and side walls of second housing member 16 are sized such that when the housing members are in their closed positions, the first housing member 14 substantially encloses the second housing member 16, i.e., side walls 24 of the second housing member are adjacent to and within side walls 20 of the first housing member, and the entire second housing member fits within the rectangular area defined by the top and side walls of the first housing member. In addition, it is advantageous for the ends 24a, 24b of side walls 24 of the second housing member 16, which are opposite bottom wall 22 of the second housing member, to abut the top wall 18 of first housing member 14, when the two housing members are in their closed positions, as illustrated in FIG. 7.

The two housing members are connected together for pivotal movement between closed positions (FIG. 1) and open positions (FIG. 4) by a first pivot means, for example, a pivot pin generally designated 26. Pivot pin 26 includes a pivot shaft 28 (see FIG. 4), which extends through appropriate openings (not shown) in side walls 20 and 24 of the housing members, with the pivot shaft being maintained in place by appropriate shaft heads 30 located at the outside of side walls 20. If desired, one of the shaft heads 30 may be screwed on to the shaft 28 thereby enabling the pivot pin to be removed from the housing members. Alternatively, other forms of pivot pins, i.e., nuts and bolts or the like, may be used as the pivot about which the two housing members move with respect to each other. As will be explained in more detail hereinafter, the first pivot means, pivot pin 26, connects the two housing members 14 and 16 together, at their respective ends 20*a*, 24*a*, thereby enabling the first and second housing members to pivot about the first pivot means between open and closed positions.

As indicated hereinbefore, the lock pick mechanism 10 also includes a frame 13 which is formed by frame members 32 and 33 (see FIG. 7). Frame member 32, which is substantially identical to frame member 33, is generally elongate in constructon and is connected, at one end thereof, to housing members 14 and 16. Specifically, the pivot shaft 28 of the first pivot means passes through an opening 34, which is located at one end 36 of frame member 32 (see FIG. 8) such that the frame member 32 is pivotally movable about the pin and is adjacent the side wall 24 of the second housing member 16. Similarly, frame member 33 is connected adjacent the other side wall of second housing member 16, at one of its ends, by the pivot shaft 28 which passes through an appropriate opening (not shown) located at one end of the frame element.

The frame 13 formed by frame members 32 and 33 is adapted to receive a plurality of lock picks 15, for example, the six lock picks 38, 40, 42, 44, 46 and 48 illustrated in FIG. 4. A second pivot means 50, which is connected near the other end 52 of the frame members 32 and 33, is provided for connecting the lock picks 38 - 48 together for pivotal movement between storage and operative positions, as will be explained.

More particularly, the second pivot means 50, which may consist of an appropriate pivot shaft 53, is connected between frame members 32 and 33. Appropriate fastening elements 54 are connected to the pivot shaft (see FIG. 7) for connecting the pivot shaft respectively between the two frame members. The fastening elements should not extend past the frame members 32 and 33 to any great extent, since the fastening elements should not interfere with the closure of second housing member 16. The pivot shaft 53 passes through appropriate openings 56 in the lock picks (see FIG. 8) thereby enabling the lock picks to pivot about the pivot shaft between storage and operative positions. As illustrated most clearly in FIG. 4, each of the lock picks includes a pick end 58a through 58*f*, respectively, which is adapted to be inserted into the tumbler of a lock mechanism.

In order to separate the individual lock picks 38 – 48, one from the other, the lock pick mechanism advantageously includes a plurality of spacer elements, 60, 62, 64, 66 and 68, which are interleaved between the lock picks. Thus, as shown in FIG. 7, spacer element 60 is disposed between lock pick 38 and lock pick 40 to separate these two lock picks, one from the other; spacer element 62 is disposed between lock picks 40 and 42; etc.

Figure 8:
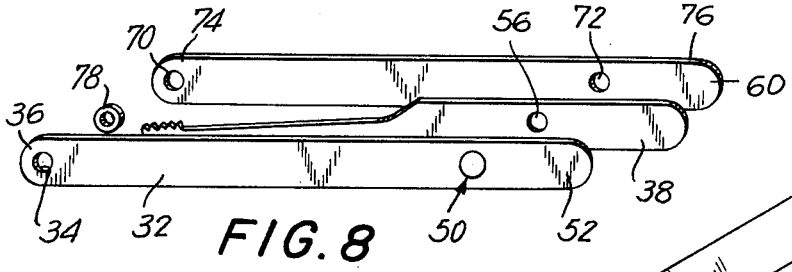
FIG. 8 is an exploded view showing certain components of the lock pick mechanism of the present invention.

Each of the spacer elements are of substantially identical structure and are substantially identical to the two frame members 32 and 33 heretofore described. More specifically, and as indicated in FIG. 8, which illustrates a spacer element 60, each of the spacer elements include two openings 70 and 72. One of the openings 70, located at an end 74 of the spacer element, is provided to enable the shaft 28 of the first pivot means 26 to pass through the spacer element. The other opening 72 is located near the other end 76 of the spacer element and is provided to receive the shaft 53 of the second pivot means 50.

As also illustrated most clearly in FIG. 8, the lock pick mechanism includes a series of washers (only one washer, 78, is shown in FIG. 8). The washers are provided to separate the various spacer elements, one from the other, to separate spacer element 60 from frame member 32 and to separate spacer element 68 from frame member 33. These washers are chosen to be of a width slightly greater than the width of the lock picks and are located about the shaft 28 of the first pivot means 26. The various washers 78 thus maintain the distance between the spacer elements and the frame of the lock pick mechanism so that the lock picks may be easily moved into and out from their storage positions.

Having now described the structure of the lock pick mechanism 10, its operation will most readily be understood by reference to FIGS. 1 – 6.

Specifically, FIG. 1 of the drawings shows the lock pick mechanism 10 with each of the lock picks 60 – 68 in their storage positions and with both of the housing members 14 and 16 in their closed positions. FIG. 1 thus shows the lock pick mechanism in a condition wherein the mechanism is not in use. In such a position, each of the pick ends 58a through 58f of the lock picks face toward the first pivot means, that is, face toward the pivot pin 26, and the pick ends are contained within the frame 13 provided by frame members 32 and 33. Further, the pick ends (and substantially the rest of the lock picks), as well as the spacer elements 60 – 68 and frame members 32 and 33, are adapted to be substantially enclosed by the first and second housing members.

Figure 2:
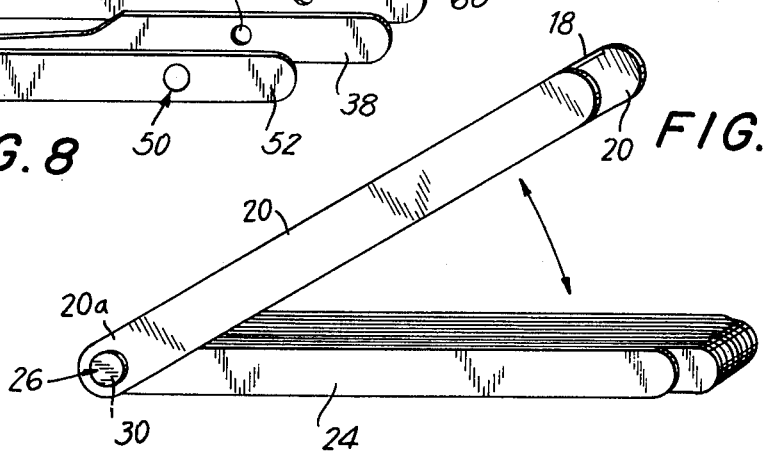
FIG. 2 is a view similar to that of FIG. 1, but showing one of the housing members being moved from its closed position.
Figure 3:
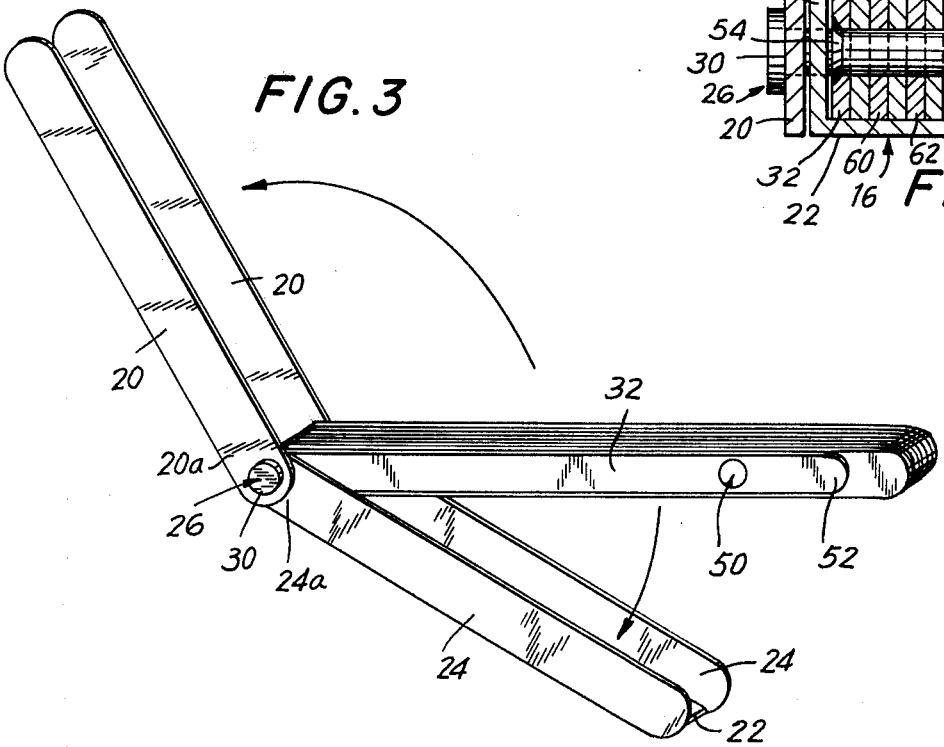
FIG. 3 is a view similar to that of FIG. 1, but showing one of the housing members in its open position and the other housing member being moved from its closed position.

When the user wants to select one of the lock picks, the user rotates the first housing member 14 about first pivot means 26 from the closed position shown in FIG. 1 to the fully open position illustrated in FIG. 3 (FIG. 2 illustrates an intermediate position of the first housing member). Similarly, the second housing member 16 is rotated about first pivot means 26 from its closed position to its fully opened position illustrated in FIG. 4 (FIG. 3 shown the second housing member in an intermediate position). With both of the housing members in their open positions (FIG. 4), the user then selects the particular lock pick which is to be used. As indicated in FIG. 4, the selection of the lock pick is made relatively easy by the fact that the several lock picks may be rotated about the second pivot means 50 in a way such that the various pick ends 58a through 58f are rotated out of alignment with the frame members 32 and 33 thereby exposing the various pick ends for view and ultimate selection.

As indicated in FIG. 5, once a particular lock pick has been selected (for example, lock pick 42), the other lock picks are rotated back to their storage positions, i.e., with the pick ends of the lock picks facing the first pivot means 26, with the pick ends being in the plane generally defined by the first and second pivot means, and with the pick ends being intermediate the first and second pivot means.

Lock pick 42, as also illustrated in FIG. 5, is moved to its operative position. In this position, the pick end 58c, although still in the plane defined by the first and second pivot means, now extends away from the first pivot means, i.e., the second pivot means is now intermediate the first pivot means and the pick end. Lock pick 42 has thus been rotated approximately 180° from its storage to its operative position.

With the selected lock pick in its operative position and the other lock picks in their storage positions, the two housing members, 16 and 18, are rotated about their first pivot means 26 from their open positions (FIG. 4) toward their closed positions. FIG. 5 illustrates the rotation of the first and second housing members about the first pivot means and illustrates these two housing members in an intermediate position between their fully opened positions (FIG. 4) and their closed positions (FIG. 6).

FIG. 6 illustrates the position of the various components of the lock pick mechanism, when the user of the mechanism is using the tool. In this position, the selected lock pick 42 is in its operative position, with its lock pick end 58c extending from the frame and housing of the lock pick mechanism. With the various components of the lock pick mechanism in the position shown in FIG. 6, it will be appreciated that the pick ends of the lock picks which are in the storage positions are contained within the frame and are enclosed by the housing members. Furthermore, the housing members lock the selected lock pick 42 in its operative position. This enables the selected lock pick to be held fairly rigid and inserted into a tumbler mechanism. Manipulation of a lock pick may be accomplished by the user grasping the closed housing members and using this part of the lock pick mechanism as a handle.

After lock pick 42 has been used, the housing members are opened and the lock pick may be rotated back to its storage position. Selection of another lock pick may be made and this pick is rotated to its operative position with the housing members being thereafter closed to keep this new pick in its operative position.

It will be appreciated, therefore, that the above described structure provides a lock pick mechanism which has several advantages over lock pick configurations of the prior art. The lock pick mechanism provides quick and easy selection of a lock pick from a plurality of lock picks. The selected lock pick is maintained in its operative position by the two housing members; while the non-selected lock picks are maintained in their storage positions by the housing members. The lock pick mechanism may be manufactured relatively inexpensively, and the overall configuration is rugged.

It is to be understood that the above described embodiment is merely illustrative of the principles of the present invention. For example, the two housing members may be L-shaped (rather than U-shaped as described in the illustrative embodiment). Other cross-sectional shapes of the two housing members are also possible, the only requirement being that the two housing members cooperate with each other to enclose the lock picks, with the two housing members being able to pivot, with respect to each other. Similarly, although it is advantageous to utilize separate spacer elements and washers, the spacer elements may be formed as part of the housing members and may even be eliminated, if so desired. It is to be understood, therefore, that the above embodiment is merely illustrative, and numerous modifications thereof will be apparent to those skilled in the art, without departing from the spirit and scope of the present invention, as set forth in the appended claims.

I claim:

1. A lock pick mechanism comprising first and second housing members, first means for connecting said housing members together for pivotal movement between open and closed positions, a frame secured at one end thereof to said first means, a plurality of lock picks, second means disposed at the other end of said frame for connecting said lock picks together for pivotal movement between storage and operative positions, each of said lock picks having a pick end which faces toward said first means when said lock pick is in its storage position and which faces away from said first means when said lock pick is in its operative position, said plurality of lock picks and said housing members being adapted such that said pick ends may be contained within said frame and enclosed by said housing members when said lock picks are in their storage positions and said housing members are in their closed positions and such that any individual one of said lock picks may be rotated from its storage position to its operative position when said housing members are in their open positions, said individual lock pick being locked in its operative position with its pick end extending from said frame and said housing members when said housing members are in their closed positions.

2. A lock pick mechanism according to claim 1 further comprising means for separating said plurality of lock picks one from the other when said lock picks are in their storage positions.

3. A lock pick mechanism according to claim 2 wherein said separating means includes a first plurality of spacer elements each located between said first means and said second means, said first spacer elements interleaved between said plurality of lock picks.

4. A lock pick mechanism according to claim 3 wherein said separating means further includes a second plurality of spacer elements located on said first means and interleaved between said first spacer elements.

5. A lock pick mechanism according to claim 1 wherein said first housing member and said second housing member are each U-shaped in cross-section.

6. A lock pick mechanism according to claim 5 wherein said second housing member is adapted to be enclosed by said first housing member when said housing members are in their closed positions.

7. A lock pick mechanism according to claim 1 wherein said first housing member includes a top wall and two parallel, depending side walls and said second housing member includes a bottom wall and two parallel, upstanding side walls, said side walls of said second housing member adapted to be adjacent to said side walls of said first housing member and within the confines of said first housing member when said housing members are in their closed positions.

8. A lock pick mechanism according to claim 7 wherein said first means for pivotally connecting said first and second housing members together includes a pivot pin disposed through the side walls of the first and second housing members.

9. A lock pick mechanism according to claim 8 wherein said second means for pivotally connecting said plurality of lock picks together includes a pivot pin connected between said frame and disposed through apertures in said lock picks.

* * * * *